US011497259B1

(12) United States Patent
Womack

(10) Patent No.: US 11,497,259 B1
(45) Date of Patent: Nov. 15, 2022

(54) BENCH PRESS SUPPORT GARMENT FOR RESISTANCE EXERCISE

(71) Applicant: Michael Womack, Princeton, TX (US)

(72) Inventor: Michael Womack, Princeton, TX (US)

( * ) Notice: Subject to any disclaimer, the term of this patent is extended or adjusted under 35 U.S.C. 154(b) by 213 days.

(21) Appl. No.: 16/565,402

(22) Filed: Sep. 9, 2019

Related U.S. Application Data

(63) Continuation-in-part of application No. 14/555,427, filed on Nov. 26, 2014, now Pat. No. 10,405,589.

(51) Int. Cl.
*A41D 13/00* (2006.01)
*A41D 13/05* (2006.01)

(52) U.S. Cl.
CPC ..... *A41D 13/0512* (2013.01); *A41D 13/0015* (2013.01)

(58) Field of Classification Search
CPC . A41D 13/0512; A41D 13/0015; A63B 21/00
See application file for complete search history.

(56) References Cited

U.S. PATENT DOCUMENTS 1,639,198 A * 8/1927 Pease ..... A61F 5/14 602/65
2,808,267 A * 10/1957 Heaton ..... A63B 69/0059 473/212
2,986,740 A * 6/1961 Schudson ..... A41D 27/10 2/115
3,324,851 A * 6/1967 Posner ..... A61F 5/3723 128/878
3,548,818 A * 12/1970 David ..... A61F 13/146 602/19
3,724,846 A * 4/1973 Perrine ..... A63B 71/12 482/106
4,273,328 A * 6/1981 Ozbey ..... A63B 21/00185 2/115
4,369,775 A * 1/1983 Gamm ..... A61F 5/3738 602/62
4,412,357 A * 11/1983 Mincher ..... A41D 13/0017 2/118
4,570,929 A * 2/1986 Shoemaker ..... A63B 21/0004 112/413
4,741,719 A * 5/1988 Wirth ..... A41D 31/185 450/30
4,890,841 A * 1/1990 Brooks ..... A63B 69/0059 473/212
4,993,705 A * 2/1991 Tolle ..... A63B 21/00185 482/124

(Continued)

*Primary Examiner* — Richale L Quinn
(74) *Attorney, Agent, or Firm* — Michael Diaz

(57) ABSTRACT

A support garment for use during resistance training. The support garment includes a band of elastomeric material having a front perimeter and a rear perimeter. The front perimeter and rear perimeter are folded together at two points, each point forming a segment. The segments are then affixed to each other at a midpoint. In addition, openings are formed on both sides of the segments with upper arm sleeves encompassing the openings. Each upper arm sleeve is configured for wear on an upper arm of a user above an elbow of the user. The upper arm sleeves are biased inwardly by the attached segments. The user positions one arm in each upper arm sleeve and positions the attached segments across a chest of the user during resistance training.

9 Claims, 12 Drawing Sheets

(56) References Cited

U.S. PATENT DOCUMENTS 5,308,305 A * 5/1994 Romney ..... A63B 21/4025 2/69
5,573,487 A * 11/1996 Wallner ..... A63B 21/0004 482/122
5,624,388 A * 4/1997 Lehr ..... A61F 5/0118 602/20
6,047,406 A * 4/2000 Dicker ..... A41D 13/0015 2/69
6,231,488 B1 * 5/2001 Dicker ..... A63B 21/0552 482/124
6,364,614 B1 * 4/2002 Mnatsakanian ..... A63H 33/40 416/223 R
6,892,396 B2 * 5/2005 Uno ..... A41D 13/0015 2/115
D537,609 S * 3/2007 Horowitz ..... D2/500
D620,252 S * 7/2010 Keels ..... D3/247
7,908,670 B2 * 3/2011 Semba ..... A63B 21/055 2/69
8,312,566 B2 * 11/2012 Weir ..... A63B 23/18 2/69
D678,434 S * 3/2013 Hughes ..... D21/692
8,454,484 B2 * 6/2013 Keen ..... A63B 21/02 482/92
8,771,155 B1 * 7/2014 Bell ..... A63B 21/4017 482/124
9,009,863 B2 * 4/2015 Decker ..... A41D 31/185 2/44
D748,209 S * 1/2016 Alaniz, III ..... D21/662
9,655,389 B2 * 5/2017 Blakely ..... A41D 1/04
10,363,452 B2 * 7/2019 Alaniz, III ..... A41D 31/18
D908,969 S * 1/2021 Forell ..... D29/101.3
10,912,374 B2 * 2/2021 Hopple ..... A45C 13/30
D922,688 S * 6/2021 Forell ..... D29/101.3
2008/0214330 A1 * 9/2008 Goebel ..... A63B 21/4021 473/438
2009/0062704 A1 * 3/2009 Brown ..... A41D 13/0015 602/19
2010/0050313 A1 * 3/2010 Shackelford, Jr. ..... A41D 13/1245 2/69
2012/0295777 A1 * 11/2012 Zaki ..... A63B 23/035 482/122
2014/0171275 A1 * 6/2014 Tatum ..... A63B 21/4025 482/124
2018/0256937 A1 * 9/2018 McCracken ..... A63B 21/4017

* cited by examiner

BENCH PRESS SUPPORT GARMENT FOR RESISTANCE EXERCISE

RELATED APPLICATIONS

This application is a continuation-in-part application of co-pending U.S. patent application Ser. No. 14/555,427 entitled "Support Garment For Resistance Exercise" filed on Nov. 26, 2014 under the name of Michael Womack and also claims the benefit of U.S. Provisional Patent Application Ser. No. 62/871,973 filed Jul. 9, 2019 by Michael Womack, which are both hereby incorporated by reference.

BACKGROUND OF THE INVENTION

Field of the Invention

This invention relates to clothing. Specifically, and not by way of limitation, the present invention relates to a garment for use in assisting during resistance training, such as weight training.

Description of the Related Art

Resistance training, such as weight training, weightlifting, or powerlifting is an excellent form of exercise, sport, and form of rehabilitation for injured patients. However, with the use of weights or other resistance devices, there is an inherent risk to damaging a person's shoulders during various resistance exercises. In one example, in the sports of weightlifting and powerlifting, a popular event is bench pressing where an individual attempt to bench press a maximum weight. Unfortunately, the geometry of the movement of the heavy weight places an extreme stress on the individual's shoulders. To assist in the reduction of this stress, many participants in this event utilize support garments providing a tight fit over the entire upper torso of the individual, thereby reducing some of the stress on the shoulders. These shirt garments are typically constructed of a heavy elastic material and fit very tightly around the individual. It is often very difficult to remove and put on these shirt garments. Additionally, although these existing garments assist in supporting the individual during the lift, even more support is needed to further reduce the stress to the individual to avoid injury during the bench press event.

Although there are no known prior art teachings of a garment such as that disclosed herein, a prior art reference that discusses subject matter that bears some relation to matters discussed herein is U.S. Pat. No. 8,771,155 to Bell (Bell). Bell discloses an exercise apparatus having two arm cuffs and a central rectangular-shaped piece of material connecting the two arm cuffs. The cuffs are sized and shaped to fit over the arms and cover the elbows of the user. Although the Bell apparatus does provide some support to the user during resistance exercise, Bell suffers from several disadvantages. The apparatus provides limited support to the user as support is merely providing at a region of the person's elbows and the areas adjacent to the elbows. Furthermore, the apparatus cannot be worn under a shirt and most be worn outside of any other clothing, thereby negating the use of the apparatus during a competition.

It would be advantageous to have a garment which provides greater support to an individual during various weight resistance exercises which may be worn by the user without restriction. It is an object of the present invention to provide such a garment.

SUMMARY OF THE INVENTION

In one aspect, the present invention is directed to a support garment for use during resistance training. The support garment includes a band of elastomeric material having a front perimeter and a rear perimeter. The front perimeter and rear perimeter are folded together at two points, each point forming a segment. The segments are then affixed to each other at a midpoint. In addition, openings are formed on both sides of the segments with upper arm sleeves encompassing the openings. Each upper arm sleeve is configured for wear on an upper arm of a user above an elbow of the user. The upper arm sleeves are biased inwardly by the attached segments. The user positions one arm in each upper arm sleeve and positions the attached segments across a chest of the user during resistance training.

DESCRIPTION OF THE INVENTION

Figure 1:
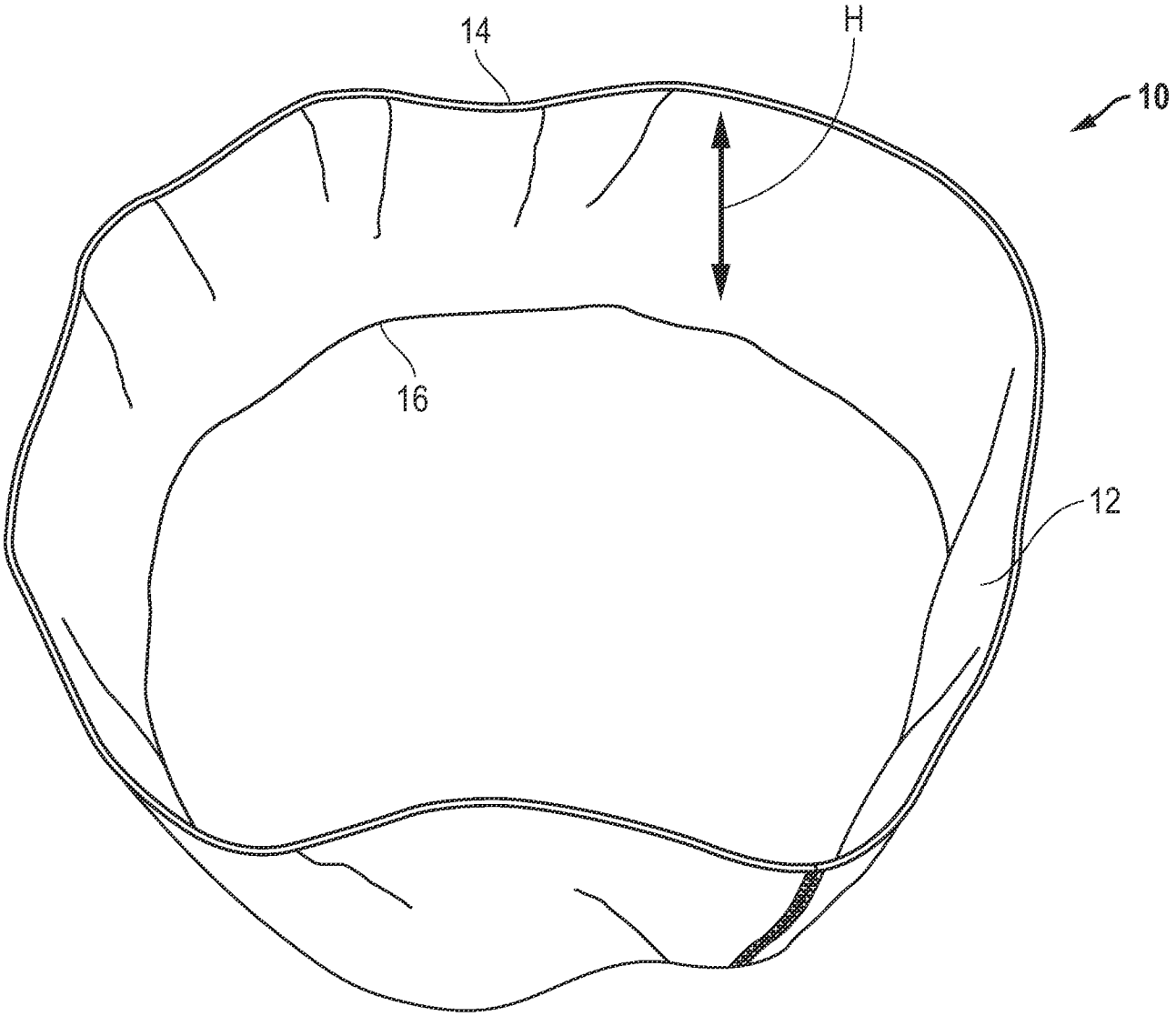
FIG. 1 is a top view of band of material of a support garment in one embodiment of the present invention.
Figure 2:
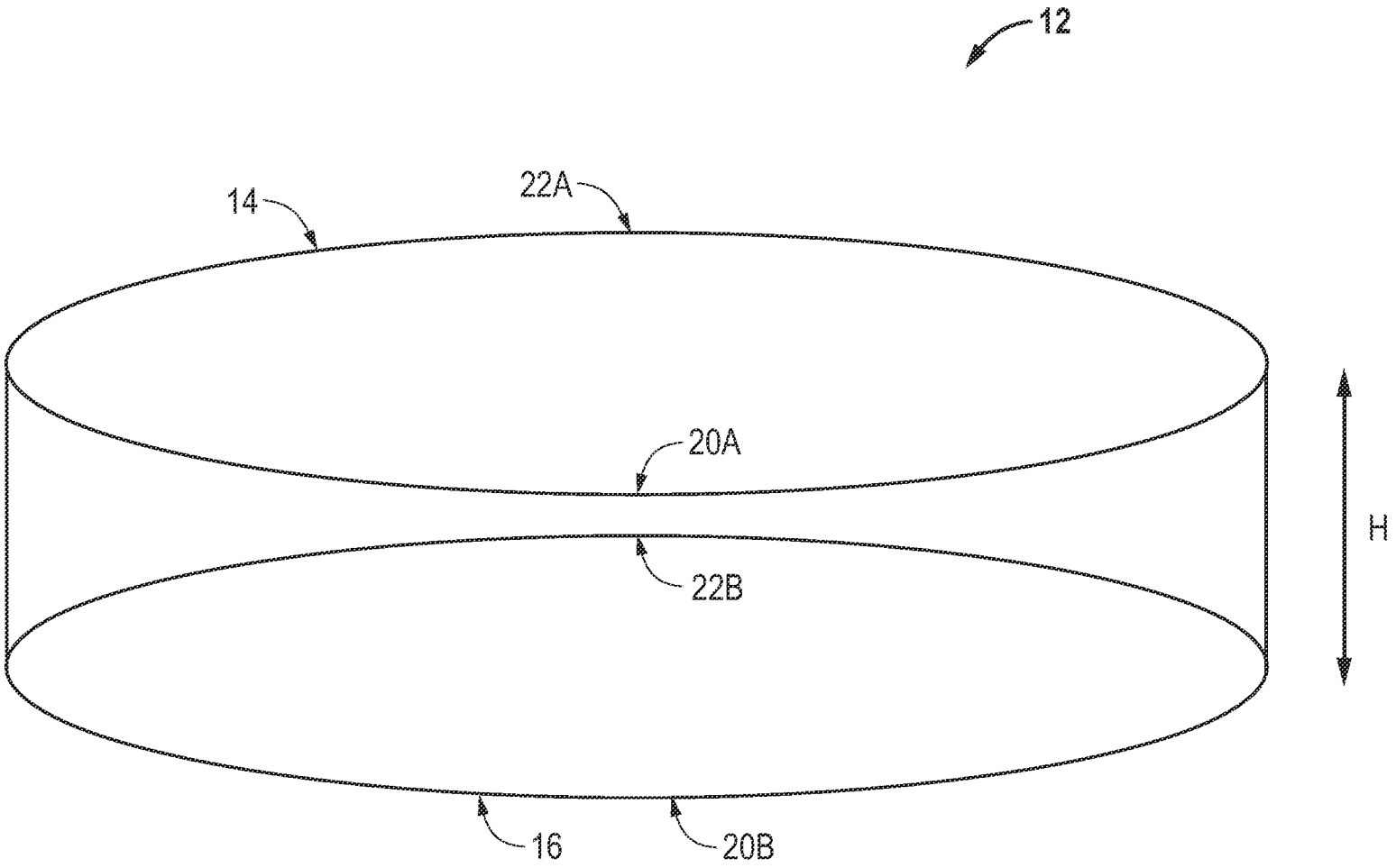
FIG. 2 is a front perspective view of the band of material of FIG. 1.
Figure 3:
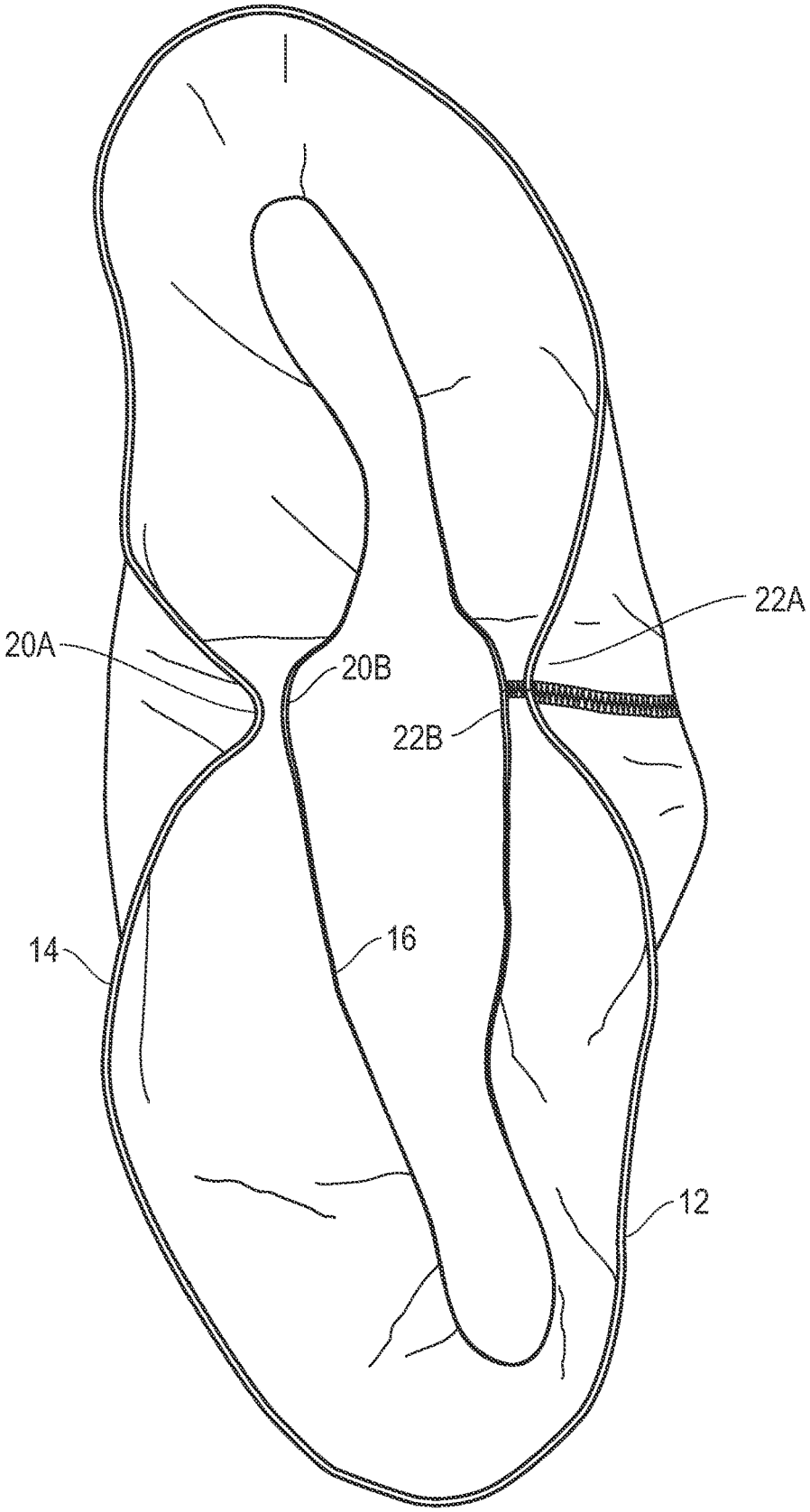
FIG. 3 is a top view of the band of material illustrating folding a portion of the band of material to configure the support garment.
Figure 4:
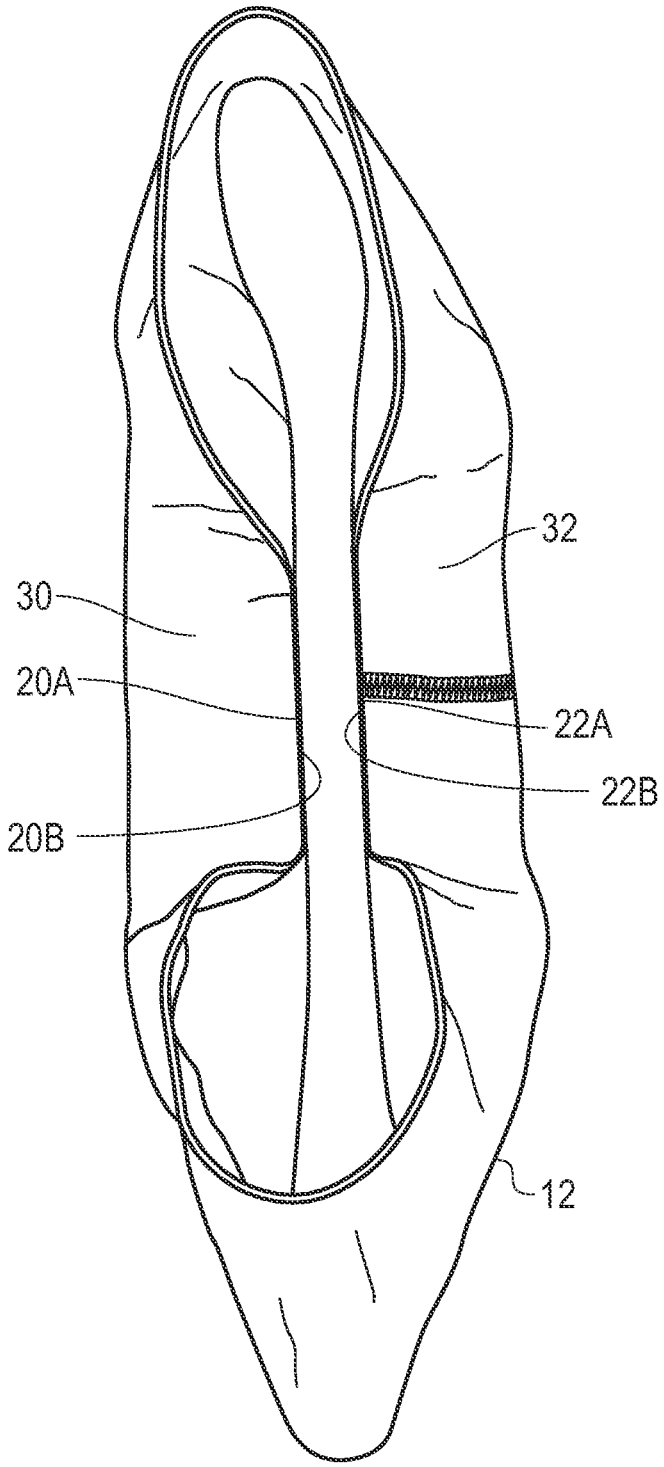
FIG. 4 is a top view of support garment of FIG. 3.
Figure 5:
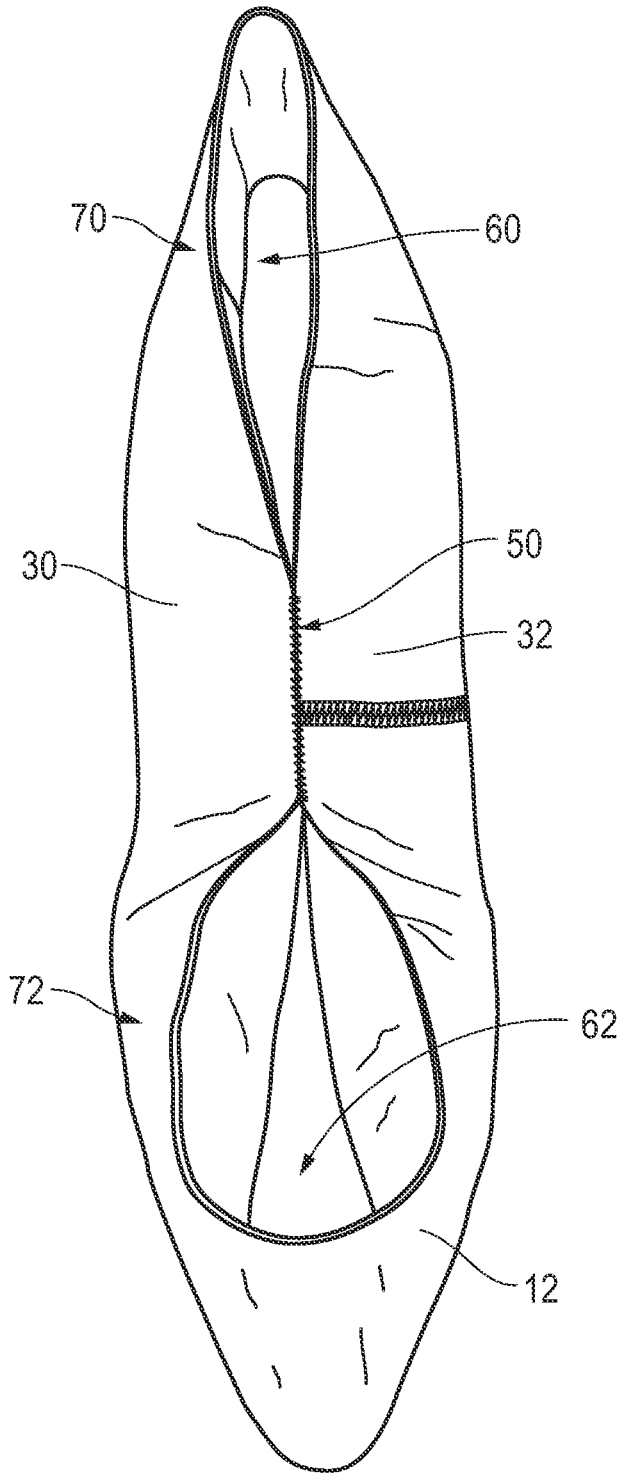
FIG. 5 is a top view of the support garment illustrating the segments.

The present invention is a garment providing support during weight resistance events. FIG. 1 is a top view of band of material 12 of a support garment 10 in one embodiment of the present invention. FIG. 2 is a front perspective view of the band of material 12 of FIG. 1. The band of material 12 includes a front perimeter 14 and a rear perimeter 1 and having a height H. FIG. 3 is a top view of the band of material 12 illustrating folding a portion of the band of material 12 to configure the support garment 10. First, the band of material is folded together at points 20A, located on the front perimeter 14 with point 20B, located on the rear perimeter 16. Likewise, on an opposing position of the band of material, the band of material 12 is folded together at point 22A, located on the front perimeter 14 with point 22B, located on the rear perimeter 16. FIG. 4 is a top view of support garment 10 of FIG. 3. The band of material is folded together at points 20A and 20B to form a first segment 30 while on the opposing side of the band of material, the band of material is folded together at points 22A and 22B to a second segment 32. FIG. 5 is a top view of the support garment 10 illustrating the segments 30 and 32. The segments 30 and 32 are positioned together and attached at a midpoint 50. The segments may be attached at a single point (point 50) or a length running both sides of midpoint 50. The segments may be attached by any fastening means such as stitching.

On either side of the segments 30 and 32 are openings 60 and 62 which form sleeves 70 and 72, each are sized and shaped to fit around the appropriate upper arm of a user with openings sized to fit above each elbow of the user. In addition, the sleeve is configured in the shape of a short sleeve of a shirt. The support garment may be constructed of a strong elastic material. In one embodiment, the elastic material is constructed from a material consisting of 70 percent elasticity and 30 percent cotton. However, the present invention may be constructed of an elastic material allowing support to the user of the support garment during resistance training.

Figure 6:
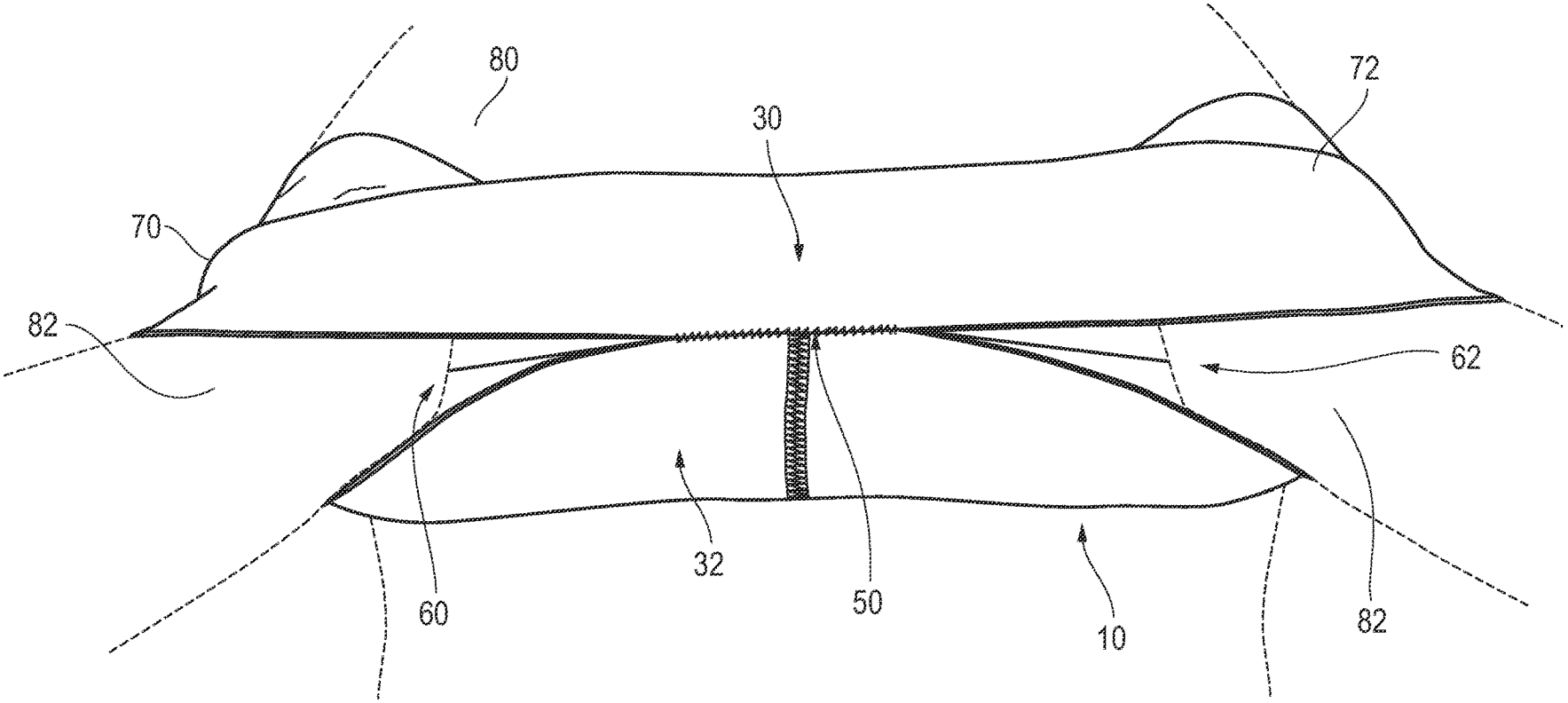
FIG. 6 illustrates the support garment being worn by a user.
Figure 7:
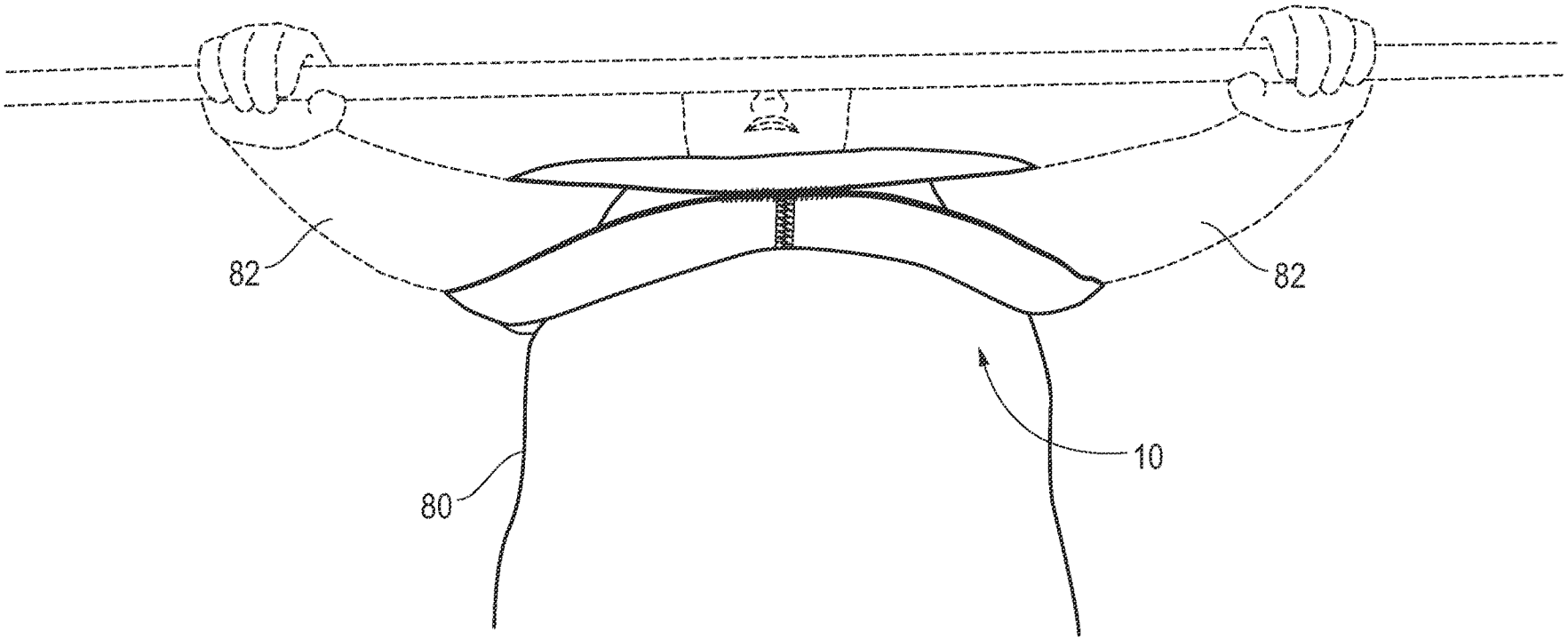
FIG. 7 illustrates a top view of the user wearing the support garment with the user's arms extended.
Figure 8:
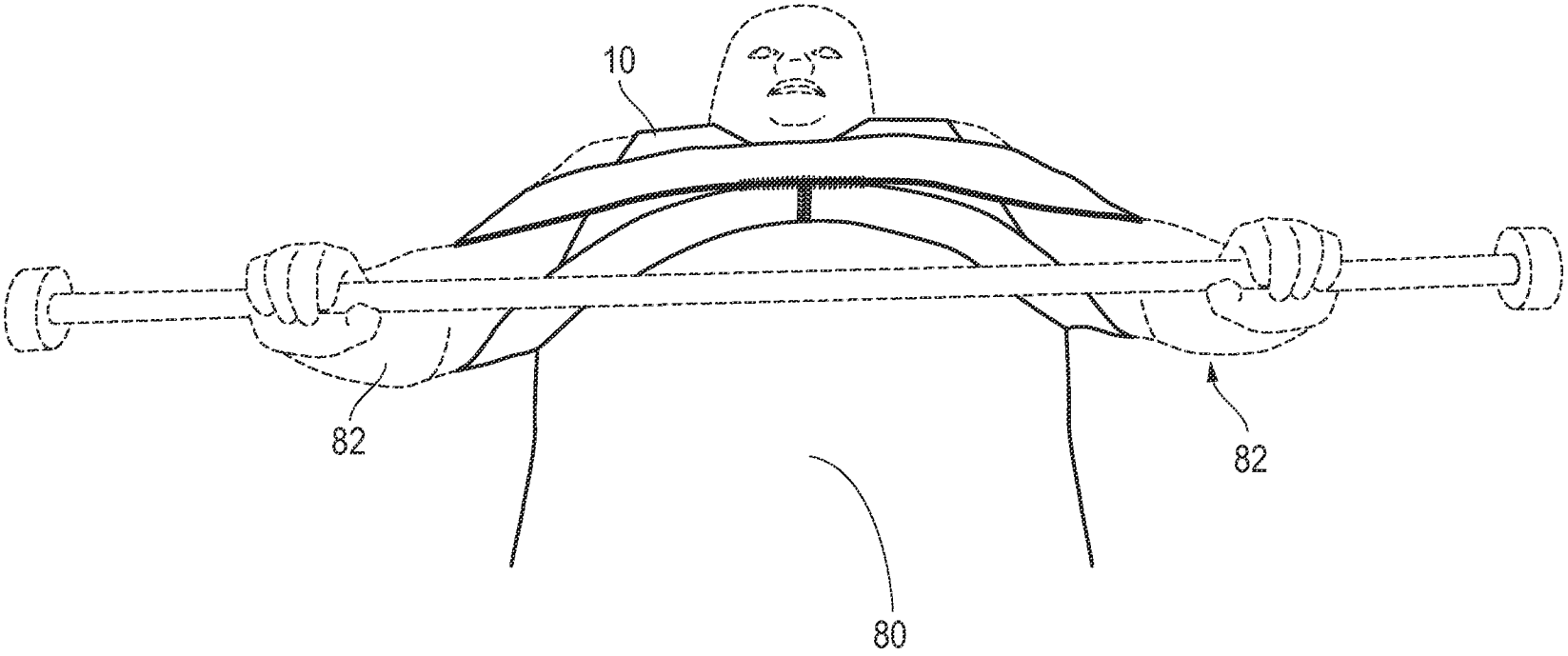
FIG. 8 illustrates a top of the user wearing the support garment 10 with the user's arms are contracted while lowering a weight.

FIG. 6 illustrates the support garment 10 being worn by a user 80. The user 80 positions the user's arms 82 through the openings 60 and 62 and are encompassed by the sleeves 70 and 72. The sleeves are sized to fit above the elbows of the user. FIG. 7 illustrates a top view of the user 80 wearing the support garment 10 with the user's arms 82 extended. With the user's arms extended upward while holding a weight bar, the support garment is biased in a contracted inward position, which results in providing support to an extended position. FIG. 8 illustrates a top of the user 80 wearing the support garment 10 with the user's arms 82 are contracted while lowering a weight. When lowering the weight bar, the user has his arms contracted to allow the weight bar to be lowered against the chest of the user. Since the support garment provides an inward bias through the attached segments, as the user lowers the bar, the support garment provides a force or support of the weight bar. The front perimeter of the support garment lies flat against the user's chest. As the user again raises the bar, the bias assists the user in raising the bar. The segments 30 and 32 lie against the user's chest when the support garment 10 is worn by the user with the arms extended and conforms against the chest of the user when the user's arms are bent (e.g., when lowering a weight bar towards the chest).

With reference to FIGS. 1-8, the operation of the support garment will now be explained. The user positions his arms 82 through the upper arm sleeves 70 and 72 with the front perimeter 14 against the chest of the user. The support garment is constructed in such a fashion that the arm sleeves are biased inwardly. Thus, with the user's arms positioned through the arm sleeves, the arms of the user are pushed inward by the bias, assisting in supporting the arms in the extended position. As the user contracts his arms and lowers the weight toward his chest, the support garment provides support as a weight is lowered.

Figure 9:
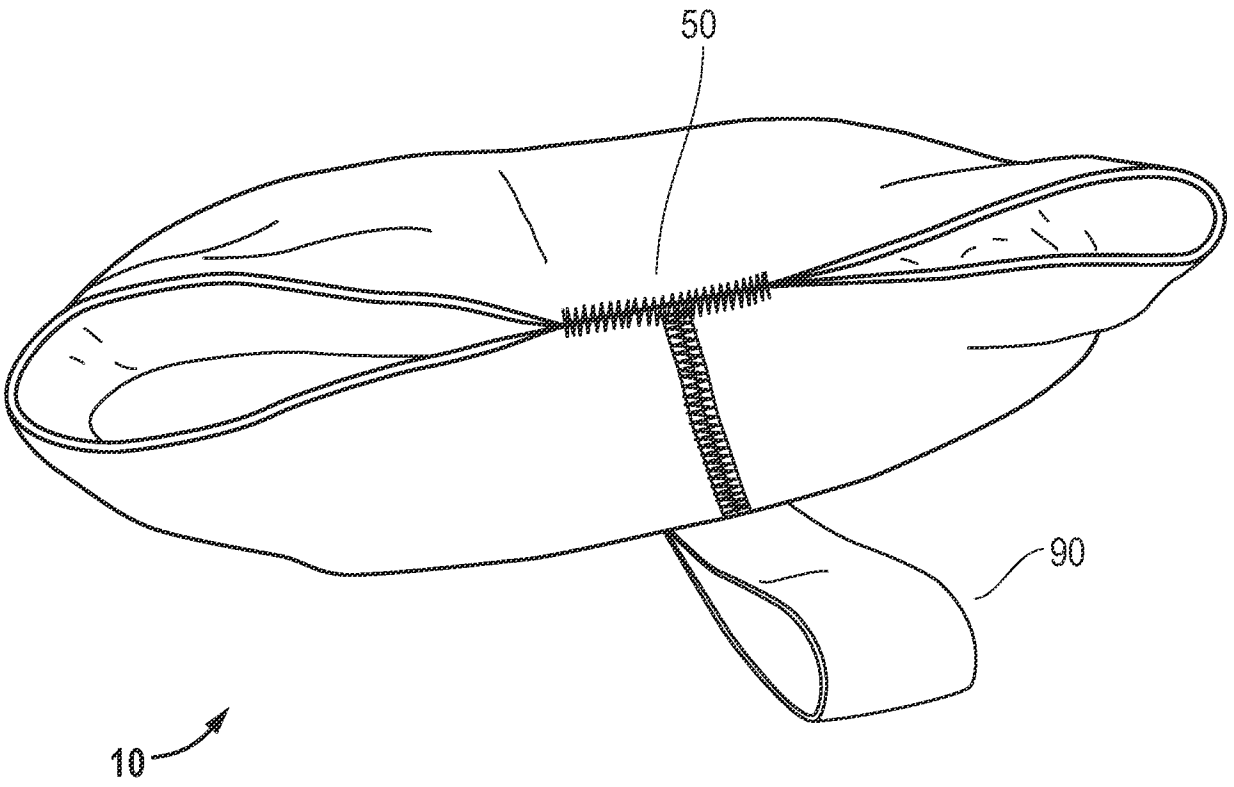
FIG. 9 illustrates the support garment with a pull strap in one embodiment of the present invention.

FIG. 9 illustrates the support garment 10 with a pull strap 90 in one embodiment of the present invention. The present invention may be configured with a pull strap 90 to facilitate the putting on and removal of the support garment 10. In addition, in one embodiment, silicone may be applied to a back portion of the support garment to prevent slippage. Additionally, the user may use just one support garment, or several applied in multiple layers depending on desired support.

In another embodiment of the present invention, the present invention includes a method of constructing a support garment for use during resistance training. The method begins by providing a band of elastomeric material having a front perimeter and a rear perimeter. The front perimeter and rear perimeter are folded at a first folding point to form a first segment and folded at a second folding point to form a second segment. The first and segments are attached to each other at a midpoint. A first opening is formed on a first side of the affixed first and second segments and a second opening is formed on a second side opposite the first side of the affixed first and second segments. An upper arm sleeve is configured to encompass each opening for accommodating arms of a user. In addition, each upper arm sleeve is configured for wear on an upper arm of a user above an elbow of the user. The attached segments provide an inward bias. The user positions one arm in each upper arm sleeve and positions the front perimeter across a chest of the user during resistance training.

Figure 10:
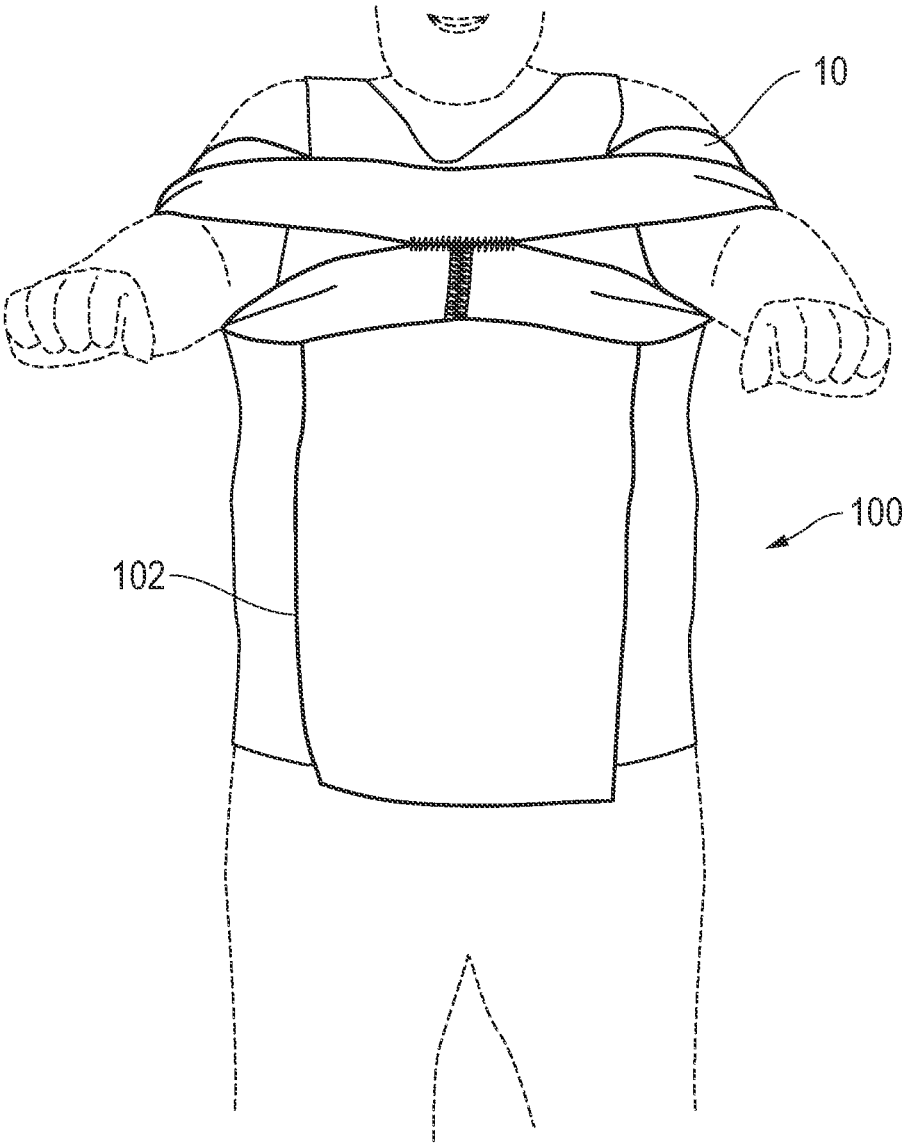
FIG. 10 is a front view of the support garment 10 used in a shirt.
Figure 11:
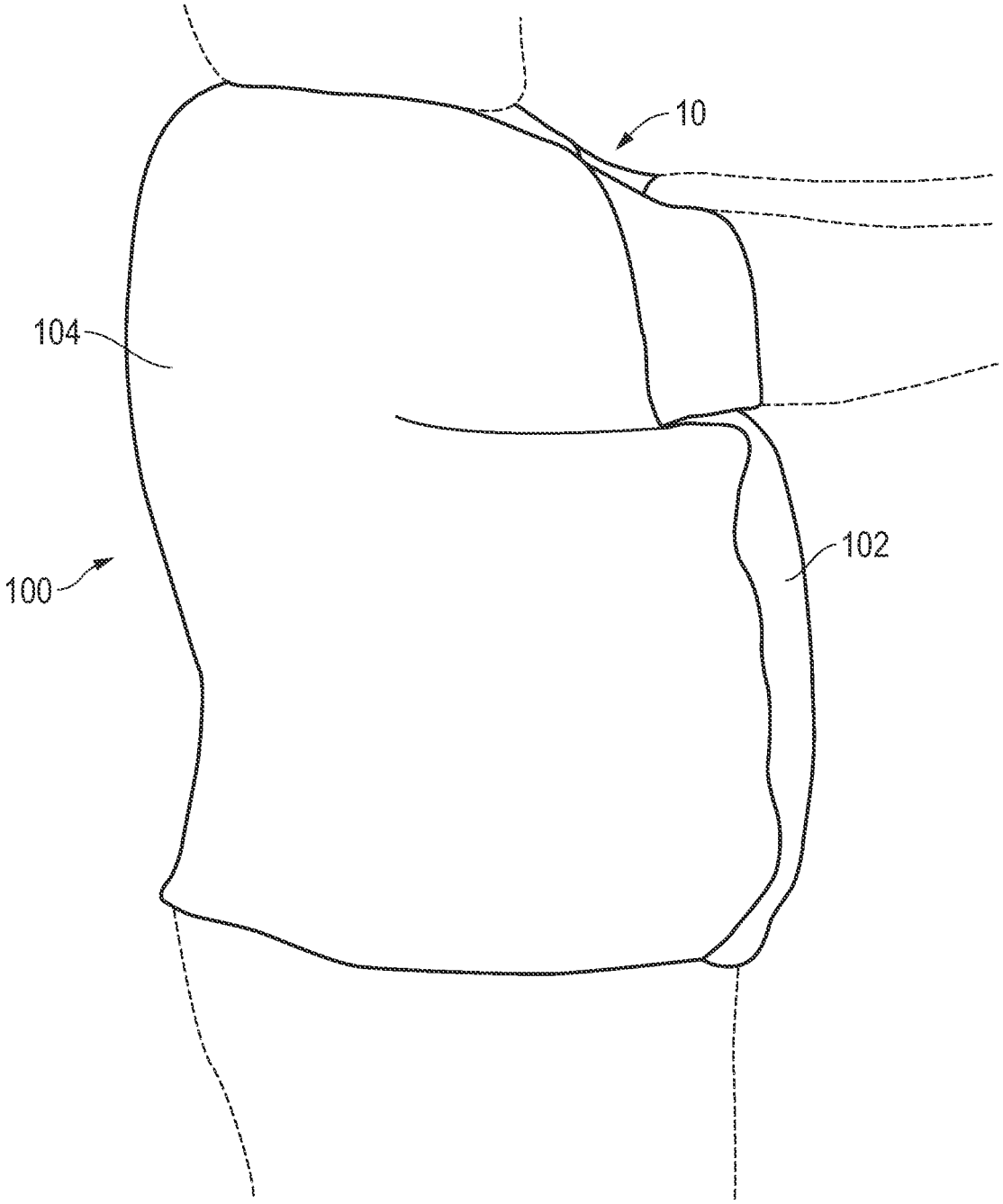
FIG. 11 is a side view of the shirt of FIG. 10.
Figure 12:
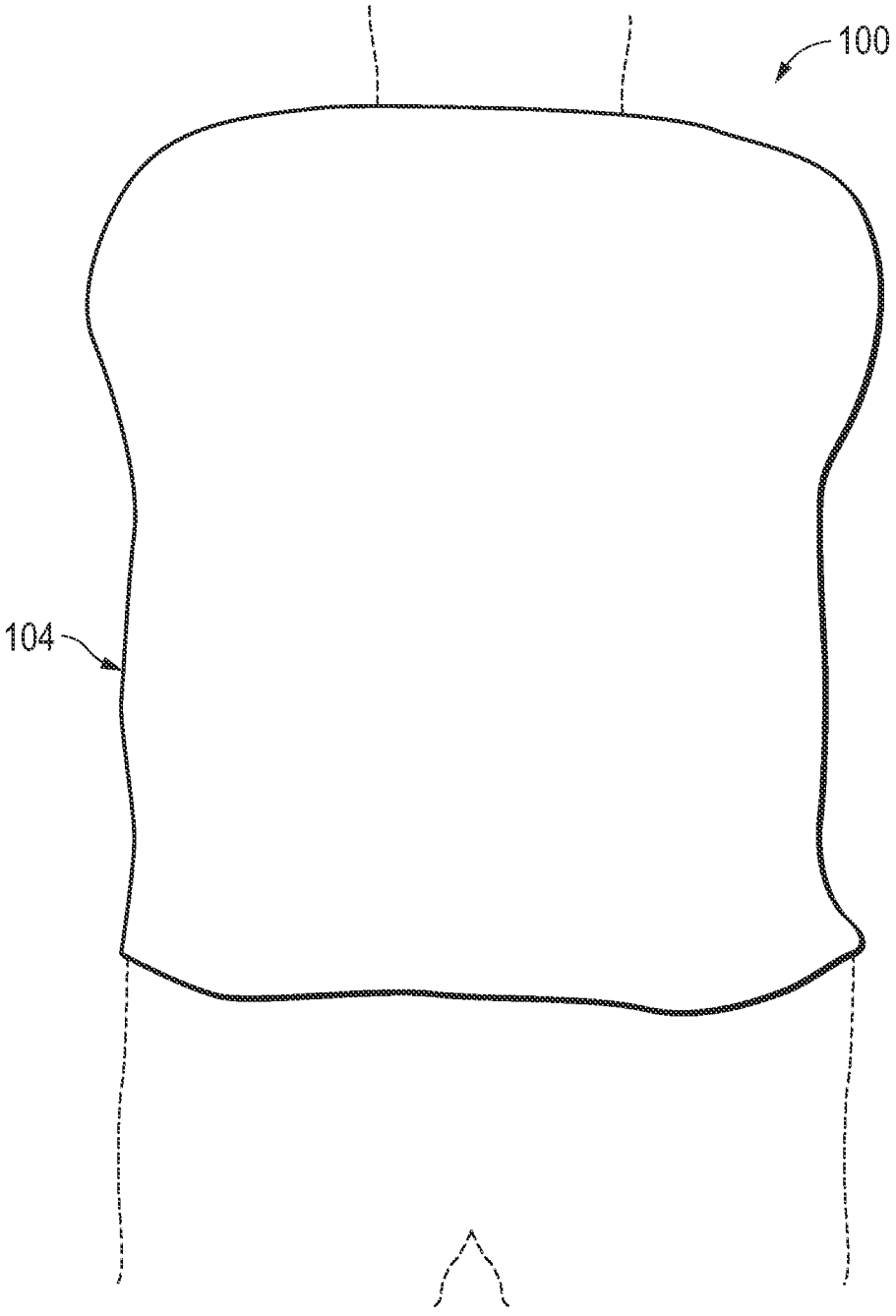
FIG. 12 is a rear view of the shirt of FIG. 10.

The present invention may be utilized for various situations, ranging from competitive weight events, rehabilitation where it is desired to reduce stress to the shoulders or any resistance training. The present invention is easy to put on or remove without the help of others. Because of the unique configuration of the upper arm sleeves, the support to the arms and shoulder enable unmatched support compared to existing devices. Additionally, when using other forms of support garments, such as disclosed in U.S. patent application Ser. No. 14/555,427, the top of the support garment tends to ride up against the user's neck when performing an exercise. The present invention provides a solution to this problem by configuring the band of material in such a fashion as it does not ride up to the neck (or throat) of the use. In an alternate embodiment of the present invention, the support garment may include a front bib section and a rear portion to be configured as a shirt. FIG. 10 is a front view of the support garment 10 used in a shirt 100. FIG. 11 is a side view of the shirt 100 of FIG. 10. FIG. 12 is a rear view of the shirt 100 of FIG. 10. The shirt includes a front bib section 102 and a rear portion 104. In such a configuration, the rear portion is located underneath a lower border (not shown) of the bib section. The rear portion is sized and shaped to fit over the back of a user. The rear portion may be made of any material and does not have to be made of a strong elastic material.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. A support garment for use during resistance training, the support garment comprising:

a band of elastomeric material having a front perimeter and a rear perimeter;

wherein the band includes a first side and a second side opposite the first side;

wherein the front perimeter and rear perimeter are folded together at a first folding point located on the first side to form a first segment;

wherein the front perimeter and rear perimeter are folded together at a second folding point located on the second side to form a second segment;

wherein the first and segments are affixed to each other at a midpoint;

wherein a first opening is formed on a first side of the affixed first and second segments and a second opening is formed on a second side opposite the first side of the affixed first and second segments;

wherein an upper arm sleeve encompasses each opening for accommodating arms of a user;

each upper arm sleeve is configured for wear on an upper arm of a user above an elbow of the user;

wherein the upper arm sleeves are biased inwardly by the attached segments;

wherein the each upper arm sleeve is configured to position one arm in one of the upper arm sleeves and the front perimeter is configured to position the front perimeter across a chest of the user during resistance training.

2. The support garment according to claim 1 wherein the front perimeter is configured to lie flat against the chest of the user.

3. The support garment according to claim 1 further comprising a bib section extending from a lower border of the support garment.

4. The support garment according to claim 3 wherein the bib section is constructed of an elastic material.

5. The support garment according to claim 3 wherein the bib section is configured to cover a region of a front torso of the user.

6. The support garment according to claim 3 further comprising a rear portion attached to the bib section and support garment.

7. The support garment according to claim 6 wherein the rear portion is a fabric configured for covering a back of the user.

8. The support garment according to claim 6 wherein the rear portion is constructed of a cotton material.

9. The support garment according to claim 1 further comprising a pull handle affixed to the support garment, the pull handle configured for facilitating the wear of the support garment on the user.

* * * * *